US007476275B2

(12) United States Patent
Ito et al.

(10) Patent No.: US 7,476,275 B2
(45) Date of Patent: Jan. 13, 2009

(54) COATING MACHINE

(75) Inventors: Masaki Ito, Aichi-ken (JP); Yasuhisa Kitajima, Aichi-ken (JP); Tamotsu Watanabe, Aichi-ken (JP); Nobuya Kobayashi, Aichi-ken (JP)

(73) Assignee: Toyoda Gosei Co., Ltd., Aichi-pref. (JP)

( * ) Notice: Subject to any disclaimer, the term of this patent is extended or adjusted under 35 U.S.C. 154(b) by 401 days.

(21) Appl. No.: 11/339,488

(22) Filed: Jan. 26, 2006

(65) Prior Publication Data

US 2006/0169203 A1 Aug. 3, 2006

(30) Foreign Application Priority Data

Jan. 28, 1920 (JP) ..... 2005-20626 U

(51) Int. Cl.
*B05C 15/00* (2006.01)

(52) U.S. Cl. ..... 118/66; 118/64; 118/326; 118/641

(58) Field of Classification Search ..... 118/64, 118/66, 326, 629, 641–643; 427/421.1, 425; 34/59, 498; 432/121, 124
See application file for complete search history.

(56) References Cited

U.S. PATENT DOCUMENTS 4,298,341 A * 11/1981 Nowack ..... 432/64
2002/0134311 A1* 9/2002 Yoshino et al. ..... 118/719

FOREIGN PATENT DOCUMENTS

| | | |
|---|---|---|
| JP | 57-177367 | 11/1982 |
| JP | 7-251124 | 10/1995 |
| JP | 7-257178 | 10/1995 |

* cited by examiner

*Primary Examiner*—Laura Edwards
(74) *Attorney, Agent, or Firm*—Posz Law Group, PLC

(57) ABSTRACT

An efficient coating machine capable of hardening coating on works in a short hardening time with a small-sized hardening oven at reduced costs. The coating machine has a painting booth, a hardening oven and a work transfer device. The work transfer device has a rotary shaft provided at a center of the coating machine, and a plurality of hangers, each holding one piece of work and being turnable about the rotary shaft. The painting booth and the hardening oven are arranged around the rotary shaft into an arc-shaped configuration, respectively. The hardening oven has an arc-shaped work passage adapted to move the works. One piece of work is coated in the painting booth and continuously transferred to the work passage of the hardening oven while being held with each of the hangers and turned about the rotary shaft. In the work passage, the work is blown with hot air fed from a hot air generating device for hardening the coating on the work.

4 Claims, 2 Drawing Sheets

COATING MACHINE

CROSS-REFERENCE TO RELATED APPLICATION

This application is related to and claims priority from Japanese patent application No. 2005-020626, incorporated herein by reference.

BACKGROUND OF THE INVENTION

1. Field of the Invention

The present invention relates to a coating machine for applying coating to works and heating the coating applied to the works for hardening.

2. Description of Related Art

In order to decorate products made of rubber, plastic, etc., reduce the sliding resistance thereof, and enhance the wear resistance thereof, coating has been frequently applied to surfaces thereof. And in order to harden the coating, the coated products have been transferred to a hardening oven, and heated therein for hardening.

In order to reduce the sliding resistance and enhance the wear resistance of weather strips, ex. for motor vehicles, a thermosetting coating has been applied to areas of the weather strips, which are adapted to contact vehicle bodies, and hardened with heat (see Publications of unexamined Japanese patent applications Nos. Hei 7-251124, and Hei 7-257178, ex.). And a device for applying a low friction coating to surfaces of the weather strips has been also contemplated (see Publication of unexamined Japanese patent application No. Sho 57-177367, ex.).

For example, as shown in FIG. 1, first, many pieces of long weather strips are placed on a pallet 10. Then, the pallet 10 on which the long weather strips are placed is transferred to a painting booth 12 in a transverse direction, and coating is automatically applied thereto with a spray gun mounted on a robot 14.

Next, the coated weather strips placed on the pallet 10 are transferred to an interior of the hardening oven 16, which is heated to an elevated temperature atmosphere with steam. In the hardening oven 16, a plurality of pallets 10 are arranged in parallel with each other in a vertical direction at spaces and moved with a conveyor from the lower side to the upper side of the hardening oven 16. The coating on the weather strips which are placed on each pallet 10 is hardened during moving in the hardening oven 16.

The pallet 10 which has moved to the upper side of the hardening oven 16, and has completed the hardening process of the weather strips moves in a transverse direction, passes over the painting booth 12, and is transferred to the upper side of a work transfer device 18. The weather strips placed on the pallet 10 are taken out of the work transfer device 18, and only the pallet 10 moves downwardly. Then, new weather strips are placed on the pallet 10 and similar coating cycles are repeated.

The above-described method of placing many pieces of works (weather strips) on the pallet 10, and subjecting the works to spray coating with the robot 14, however, requires a long coating time so as not to be efficient.

After coated, the works (weather strips) are heated in the hardening oven 16 which is in an elevated temperature atmosphere with steam so that it takes a long time to raise the temperature of the works and harden the coating thereon, and consequently, the moving time of the pallet 10 in the hardening oven 16 becomes long. For this reason, in order to increase the hardening efficiency, many pallets have been required so that the hardening oven 16 becomes great to increase the equipment costs.

SUMMARY OF THE INVENTION

Accordingly, it is an object of the present invention to provide an efficient coating machine including a small-sized hardening oven capable of hardening coating in a short time with a decreased cost.

The coating machine in accordance with the present invention for applying coating to works, and heating the coating applied to the works for hardening has a painting booth for applying the coating to the works, a hardening oven for hardening the coating applied to the works, and a work transfer device. The work transfer device has a rotary shaft located at a center of the coating machine, and a plurality of hangers, each holding one piece of work and being turnable about the rotary shaft. The painting booth and the hardening oven are arranged around the rotary shaft into an arc-shaped configuration, respectively. The hardening oven has an arc-shaped work passage adapted to move the works. One piece of work is coated within the painting booth and continuously transferred to the work passage of the hardening oven while being held with each of the hangers and turned about the rotary shaft. And in the work passage of the hardening oven, the work is blown with hot air fed from a hot air generating device for hardening the coating thereon.

With this arrangement of the coating machine, the work transfer device has the rotary shaft provided at the center of the coating machine, and a plurality of hangers, each holding one piece of work and being turnable about the rotary shaft, so that the painting booth, the hardening oven and the work transfer device can be made small, whereby the equipment costs can be reduced. In addition, the works can be coated one by one so that the number of unfinished works in the painting process can be reduced so as to be efficient. And the works can be secured to and detached from the hanger in the same operation position.

The painting booth and the hardening oven are arranged around the rotary shaft into an arc-shaped configuration, respectively, and the hardening oven has an arc-shaped work passage adapted to move the works so that by merely rotating the rotary shaft of the work transfer device, the works can move in the painting booth and the hardening oven, whereby the work transfer device can be made small.

The works are coated within the painting booth and continuously transferred to the work passage of the hardening oven while being held with the hangers and turned about the rotary shaft so that the coated works can be speedily transferred to the hardening oven, thereby carrying out the hardening process in a short time.

By blowing hot air fed from the hot air generating device to the works in the hardening oven, the coating on the works is hardened. Therefore, hot air is directly blown on coated areas on the works so that the temperature of the coated areas can be raised quickly, thereby hardening the coated areas in a short time.

It is preferable that the hardening oven includes an outside air feeding wall and an inside air feeding wall, each being tubular and having an arc-shaped cross-section. The work passage is defined between the outside air feeding wall and the inside air feeding wall. And, a plurality of screen plates are respectively provided within the outside air feeding wall and the inside air feeding wall for screening passages for hot air locally. With this arrangement, by means of the screen plates, the flow of hot air introduced in the interior of each of the outside air feeding wall and the inside air feeding wall can be controlled so that hot air can be blown from air blowing holes to the works uniformly over the entire length of the work passage from its inlet to its outlet, whereby the coating applied to the works can be hardened cirtainly.

It is preferable that one piece of work is secured to each of the hangers, and the work transfer device turns to transfer the work secured to each of the hangers to the painting booth and the hardening oven continuously. With this arrangement, since one piece of work is secured to each of the hangers, the work can be readily secured to the hanger, and just after secured to the hanger, the work can be coated and hardened so that these steps can be carried out speedily and the work transfer device can be made small. Since the works secured to the hangers are continuously transferred to the painting booth and the hardening oven, the time needed to secure, coat and harden the works can be made short.

It is preferable that the outside air feeding wall and the inside air feeding wall are arranged such that hot air is supplied to the interior of each of the outside air feeding wall and the inside air feeding wall from an inlet of the work passage and sucked out from an outlet thereof. With this arrangement, hot air can be fed over the entire length of the outside air feeding wall and the inside air feeding wall, and hot air can be blown on the work over the entire length of the work passage, whereby the coating applied to the works can be completely hardened. The hot air sucked from the outlet of the work passage is returned to the hot air generating device, heated again therein and fed to the outside air feeding wall and the inside air feeding wall. As a result, hot air can be recycled to enhance the thermal efficiency.

It is preferable that the works are weather strips, and the coating is composed of a low friction material. With this arrangement, by applying a silicon coating, etc. as the low friction material to predetermined areas of the weather strips, which are adapted to contact a door glass and surfaces of a vehicle body, these areas are hardened to prevent the occurrence of noise upon raising and lowering of the door glass, and prevent the increase of the door opening force upon closing and opening of the vehicle door.

Other objects, features, and characteristics of the present invention will become apparent upon consideration of the following description and the appended claims with reference to the accompanying drawings, all of which form a part of this specification.

DETAILED DESCRIPTION OF THE PREFERRED EMBODIMENTS

Hereinafter, one embodiment of a coating machine in accordance with the present invention will be explained with reference to FIGS. 2 and 3. A coating machine 20 of the present invention applies coating to surfaces of works and hardens the coating applied to the works with heat. The works are not limited specifically, but in the present embodiment, the coating machine 20 for weather strips 22 will be explained.

Figure 1:
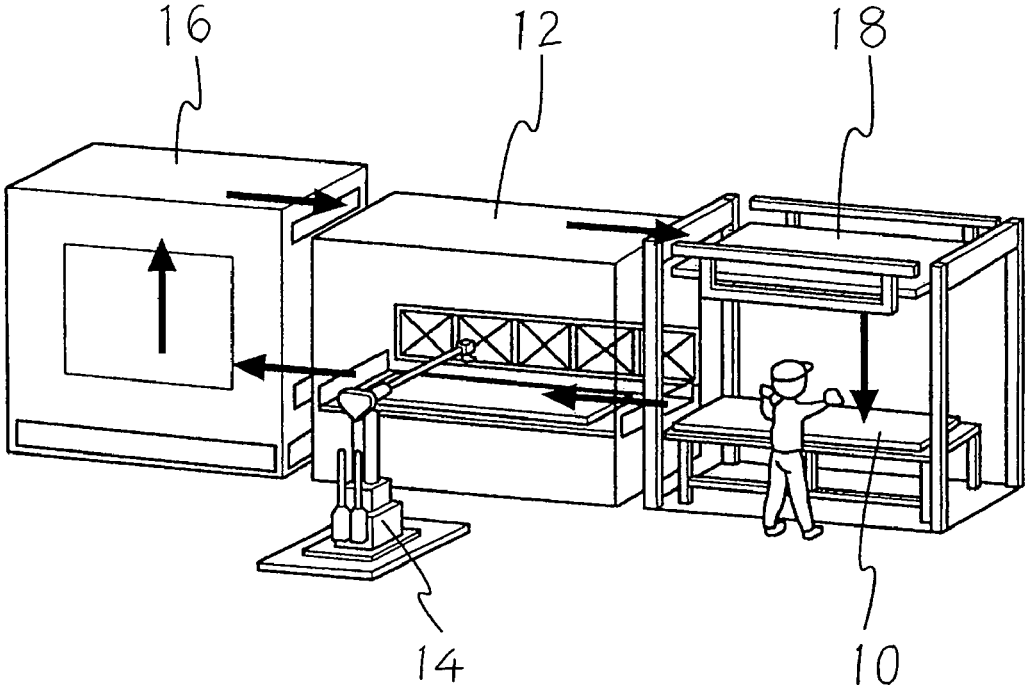
FIG. 1 (PRIOR ART)
FIG. 1 is a perspective view of a conventional coating machine.
Figure 2:
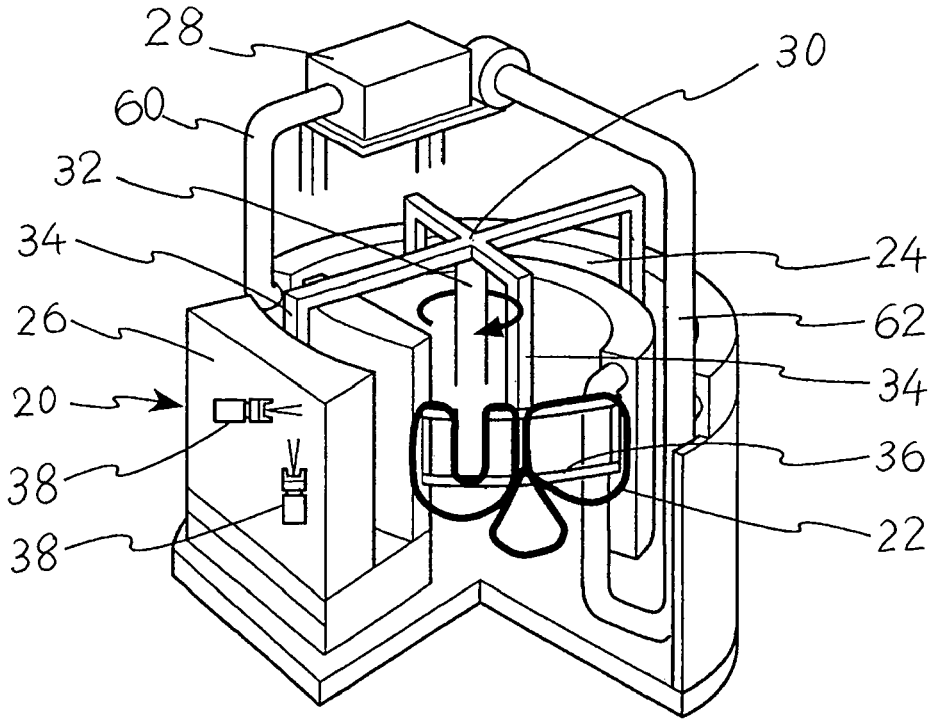
FIG. 2 is a perspective view of one embodiment of a coating machine in accordance with the present invention.
Figure 3:
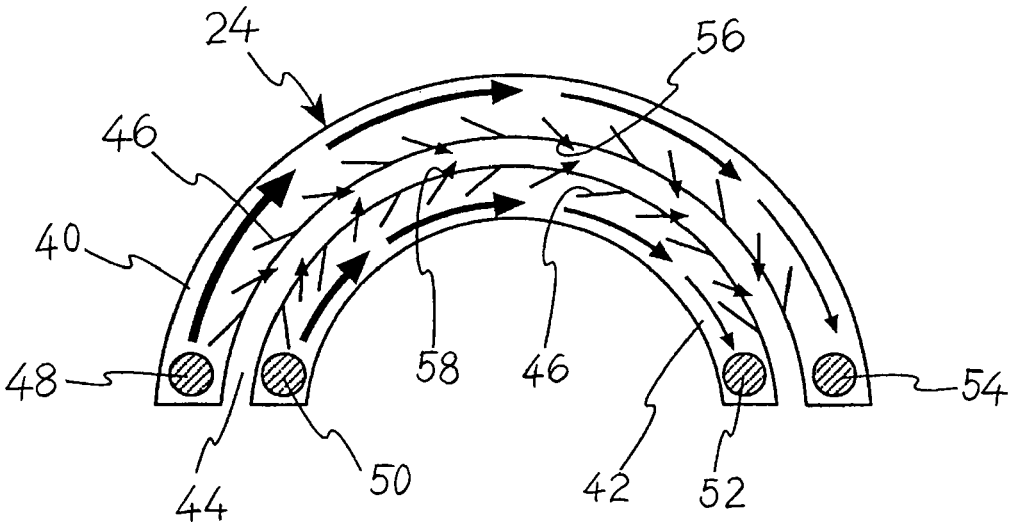
FIG. 3 is a schematic diagram showing the cross-section of a hardening oven used in one embodiment of a coating machine in accordance with the present invention.

FIG. 2 is a perspective view of the coating machine 20 and FIG. 3 is a cross-sectional view of a hardening oven 24.

As shown, the coating machine 20 includes a painting booth 26, the hardening oven 24, a hot air generating device 28 and a work transfer device 30.

The work transfer device 30 includes a rotary shaft 32, a hanger holding member 34 which extends from a top end of the rotary shaft 32 in radial directions, and further extends downwardly, and hangers 36 for holding the weather strips 22, which are secured to lower ends of the hanger holding member 34.

The rotary shaft 32 is mounted so as to be rotated with a motor, hydraulic cylinder (not shown), etc. In the present embodiment, the hanger holding member 34 includes four legs, each extending downwardly. The number of the legs can be arbitrarily increased or decreased. The hangers 36 can be formed so as to extend transversely into an arc-shaped configuration such that the weather strips 22 can be detachably secured to the hangers 36. One piece of weather strip 22 is secured to one hanger 36 into an arc-shaped configuration so as to pass interiors of the later-describing painting booth 26 and the hardening oven 24 with the rotation of the rotary shaft 32.

In order to facilitate the securing and detaching of the weather strips 22 to and from the hangers 36, a space corresponding to the area of nearly one fourth of a circumference of the coating machine is provided between the painting booth 26 and the hardening oven 24.

A plurality of spray guns 38 are provided inside the painting booth 26. When the weather strips 22 secured to the hangers 36 are transferred to the interior of the painting booth 26, the spray guns 38 can spray a coating exhibiting low sliding friction properties onto predetermined areas of the weather strips 22. The positions and the number of the spray guns are selected such that the coating can be sprayed onto the predetermined areas of the weather strips 22 when moving in the interior of the painting booth 26 with the rotation of the rotary shaft 32. The painting booth 26 is covered so as to prevent the coating sprayed with the spray gun 38 from scattering outwardly, but an open space is provided in about a central part of the painting booth 26 such that the weather strips 22 secured to the hangers 36 can move while turning about the rotary shaft 32. The painting booth 26 is located in the area of about one fourth of a circumference of the coating machine.

Next, the hardening oven 24 will be explained. The hardening oven 24 includes an outside air feeding wall 40 and an inside air feeding wall 42. And a work passage 44 is provided between the outside air feeding wall 40 and the inside air feeding wall 42 such that the weather strips 22 secured to the hangers 36 can move while turning about the rotary shaft 32. The outside air feeding wall 40 and the inside air feeding wall 42 are respectively formed to have an arc-shaped cross-section about the rotary shaft 32, and to have a rectangular longitudinal section. The outside air feeding wall 40 and the inside air feeding wall 42 are respectively formed tubular. FIG. 3 is a cross-sectional view of the hardening oven 24. The outside air feeding wall 40 and the inside air feeding wall 42 are respectively formed to have the circumferential length which can sufficiently harden the coating on each of the weather strips 22 with heat.

The outside air feeding wall 40 is arranged on the outer side of the hardening oven 24 so as to blow hot air to the weather strips 22 secured to the hangers 36 from the outer side thereof, whereas the inside air feeding wall 42 is arranged on the inner side of the hardening oven 24 so as to blow hot air from the inner side of the weather strips 22. These walls 40 and 42 face each other with a predetermined space as the work passage 44 interposed therebetween.

As described above, the outside air feeding wall 40 and the inside air feeding wall 42 are respectively formed tubular, and a large number of screen plates 46 are provided inside each of faces thereof, which define the work passage 44. The screen plates 46 are directed obliquely toward the upstream side of a flow of hot air in the interior of each of the outside air feeding wall 40 and the inside air feeding wall 42.

Hot air inlets 48 and 50 are respectively provided in one end of each of the outside air feeding wall 40 and the inside air feeding wall 42 on the inlet side of the work passage 44, whereas hot air outlets 52 and 54 are respectively provided in the other end of each of the outside air feeding wall 40 and the inside air feeding wall 42 on the outlet side of the work passage 44. Hot air flows in the interior of the outside air feeding wall 40 and the inside air feeding wall 42 from the inlet side to the outlet side thereof.

And, a large number of hot air blowing holes 56 and 58 are respectively provided in the faces of the outside air feeding wall 40 and the inside air feeding wall 42, which define the work passage 44. When hot air flows in the interior of the outside air feeding wall 40 and the inside air feeding wall 42 from their inlet sides to their outlet sides, the hot air is directed with the screen plates 46 provided inside the outside air feeding wall 40 and the inside air feeding wall 42, and blown from the blowing holes 56 and 58 onto the weather strips 22 passing the work passage 44. By varying the size and the attaching angle of these screen plates 46, the amount of hot air blown from the blowing holes 56 and 58 can be adjusted constant. The hardening oven 24 is located in the area of about one half of the circumference of the coating machine.

Next, the hot air generating device 28 will be explained. The hot air generating device 28 is mounted in the vicinity of the hardening oven 24. In the present embodiment, the hot air generating device 28 is mounted on the upper side of the hardening oven 24. The hot air generating device 28 heats air with an electric current, etc., and supplies hot air to the hardening oven 24 with an air blower. One end of an air feeding duct 60 and one end of an air sucking duct 62 are attached to the hot air generating device 28. The other end of the air feeding duct 60 is attached to the hot air inlets 48 and 50 provided in the outside air feeding wall 40 and the inside air feeding wall 42, whereas the other end of the air sucking duct 62 is attached to the hot air outlets 52 and 54 provided in the outside air feeding wall 40 and the inside air feeding wall 42.

The hot air supplied from the hot air generating device 28 flows in the air feeding duct 60, enters the hot air inlets 48 and 50 provided in the outside air feeding wall 40 and the inside air feeding wall 42, and blown from the hot air blowing holes 56 and 58 provided in the outside air feeding wall 40 and the inside air feeding wall 42 to harden the coating on the weather strips 22. The remaining hot air enters the air sucking duct 62 from the hot air outlets 52 and 54 and returns to the hot air generating device 28. Then, air is supplied to the hot air generating device 28 and heated again therein, and the hot air is supplied to the hardening oven 24 again by way of the air feeding duct 60.

Next, the method for applying coating to the works (weather strips) 22 and hardening the applied coating with heat by using the coating machine of the present embodiment will be explained.

Operators secure the weather strip 22 before coated to each of the hangers 36 in the operation space provided between the painting booth 26 and the hardening oven 24, which is shown in FIG. 2.

The weather strip 22 secured to each of the hangers 36 is transferred to the painting booth 26 with the rotation of the work transfer device 30. In the painting booth 26, in order to improve the wear resistance of sealing portions, etc. of the weather strip 22, the spray guns 38 apply a low friction coating thereto. At this time, the weather strip 22 moves within the painting booth 26 with the rotation of the rotary shaft 32 so that predetermined areas can be surely coated with a plurality of spray guns 38. While the weather strip 22 is within the painting booth 26, the rotation of the rotary shaft 32 may be stopped for a predetermined time (10 seconds, ex.) to apply coating securely.

And since the hardening oven 24 is provided continuously with the painting booth 26, the weather strip 22 coated in the painting booth 26 directly enters the hardening oven 24. In the work passage 44 of the hardening oven 24, the weather strip 22 is directly blown with hot air fed from the blowing holes 56 and 58 of the outside air feeding wall 40 and the inside air feeding wall 42. And the weather strip 22 slowly moves in the work passage 44 with the rotation of the work transfer device 30. As a result, the coating is hardened with heat. Since the hot air is directly blown onto the coating, the coating is speedily hardened with heat, whereby the hardening oven 24 can be minimized.

After the hardening process is completed, in the operation space between the painting booth 26 and the hardening oven 24, the operators take the coated weather strip 22 out of the hanger 36, and secure another weather strip before coated thereto. In this manner, the coating and the hardening of the weather strips 22 can be continuously carried out. And the works such as weather strips can be coated one by one so that the number of works remaining unfinished in the coating machine can be reduced, which is efficient. In addition, works can be secured and detached in the same operation position as each other.

With the coating machine in accordance with the present invention, since the painting booth and the hardening oven are arranged around the rotary shaft into an arc-shaped configuration, respectively, and the hardening oven has an arc-shaped work passage adapted to move works so that by merely rotating the rotary shaft of the work transfer device, the works can move in the painting booth and the hardening oven while turning, whereby the coating machine can be made small, and the coated works can be speedily transferred to the hardening oven, thereby carrying out the hardening process in a short time.

In addition, since hot air fed from the hot air generating device is blown on the works during moving in the work passage, hot air can be directly blown on the coated areas on the works so that the temperature of the coated areas can be raised quickly, thereby hardening the coated areas quickly.

While the invention has been described in connection with what are considered to be the preferred embodiments, it is to be understood that the invention is not limited to the disclosed embodiments, but, on the contrary, is intended to cover various modifications and equivalent arrangements included within the spirit and scope of the appended claims.

What is claimed is:

1. A coating machine for applying a coating to works, and heating the coating applied to the works for hardening, comprising:

a painting booth for applying the coating to the works;

a hardening oven for hardening the coating applied to the works;

a hot air generating device for feeding hot air to the works transferred in said hardening oven; and a work transfer device, wherein said hardening oven includes an outside air feeding wall and an inside air feeding wall, each being tubular and having an are-shaped cross-section, to define an arc-shaped work passage to move the works therebetween, said hardening oven further includes a plurality of screen plates which are respectively provided in an interior of each of said outside air feeding wall and said inside air feeding wall for locally screening passages for hot air fed from said hot air generating device, said work transfer device has a rotary shaft provided at a center of the coating machine, and a plurality of hangers, each holding at least one piece of the works and being turnable about said rotary shaft, and said painting booth and said hardening oven are arranged around said rotary shaft into an arc-shaped configuration, respectively, whereby the works are coated within said painting booth and continuously transferred in said arc-shaped work passage of said hardening oven while being held with said hangers and turned about said rotary shaft, and then, the works are blown with hot air fed from said hot air generating device for hardening the coating on the works.

2. A coating machine as claimed in claim 1, wherein one piece of work is secured to each of said hangers, and said work transfer device rotates to transfer said work secured to each of said hangers to said painting booth and said hardening oven continuously.

3. A coating machine as claimed in claim 1, wherein said outside air feeding wall and said inside air feeding wall are arranged such that hot air is supplied to said interior of each of said outside air feeding wall and said inside air feeding wall from an inlet of said work passage, and is sucked out from an outlet of said work passage.

4. A coating machine as claimed in claim 1, wherein the works are weather strips, and the coating is composed of a low friction material.

* * * * *